United States Patent [19]

Renker et al.

[11] Patent Number: 5,074,078

[45] Date of Patent: Dec. 24, 1991

[54] DEVICE FOR CIRCULAR AND/OR PROFILE GRINDING

[75] Inventors: Hansjörg Renker, Hilterfingen; Peter Wyler, Steffisburg, both of Switzerland

[73] Assignee: Fritz Studer AG, Fed. Rep. of Germany

[21] Appl. No.: 641,334

[22] Filed: Jan. 15, 1991

Related U.S. Application Data

[63] Continuation of Ser. No. 302,330, Jan. 27, 1989, abandoned.

[30] Foreign Application Priority Data

Jan. 30, 1988 [DE] Fed. Rep. of Germany ..... 3802792

[51] Int. Cl.[5] ..... B24B 5/00

[52] U.S. Cl. ..... 51/103 C; 51/105 R; 51/206 R

[58] Field of Search ..... 51/73 R, 103 C, 105 R, 51/206 R, 289 R, 277; 82/130, 131, 15, 12; 384/118

[56] References Cited

U.S. PATENT DOCUMENTS

| | | | |
|---|---|---|---|
| 2,173,555 | 9/1939 | Hipple | 51/73 R |
| 2,683,635 | 7/1954 | Wilcox | 384/118 |
| 2,893,292 | 7/1959 | Naperola | 82/130 |
| 3,094,822 | 6/1963 | Umbdenstock | 51/73 R |
| 3,143,382 | 8/1964 | Ertaud et al. | 384/118 |
| 3,175,548 | 3/1965 | Weiss | 51/73 R |
| 3,599,377 | 8/1971 | Dartnell | 51/277 |
| 3,817,149 | 6/1974 | Reutlinger | 51/73 R |
| 3,964,349 | 6/1976 | Von Arnauld et al. | 51/73 R |

*Primary Examiner*—M. Rachuba

*Attorney, Agent, or Firm*—Evenson, Wands, Edwards, Lenahan & McKeown

[57] ABSTRACT

In the case of a device for circular and/or profile grinding, it is provided that the grinding tool is constructed as a ring, which, on its interior circumference, is provided with an abrasive coating. In preferred embodiments the ring shaped grinding tool is a rotary part of an electric motor.

21 Claims, 2 Drawing Sheets

DEVICE FOR CIRCULAR AND/OR PROFILE GRINDING

This is a continuation of application Ser. No. 07/302,330, filed Jan. 27, 1989, now abandoned.

BACKGROUND AND SUMMARY OF THE INVENTION

The invention relates to a device for circular and/or profile grinding having a receiving device for a workpiece and having a tool, which can be driven to perform rotations and has an abrasive coating.

In devices of this type, grinding tools are used in the form of disks which, on their outer circumference, are provided with an abrasive coating. By means of devices of this type, it is possible to grind workpieces to a circular shape and/or to grind profiles, for example, in the form of recesses with radial or conical shoulders. If in this case left and right shoulders are to be ground at a workpiece, it is as a rule necessary to rechuck the workpiece. However, this rechucking often carries the risk of inaccuracies.

An object of the invention is to construct a device of the initially mentioned type such that the grinding process can be rationalized.

This object is achieved in that the grinding tool is constructed in the shape of a ring which is provided with the abrasive coating on its interior circumference.

The use of this type of a grinding tool results in several surprising advantages. On the one hand, it is possible to shape opposite shoulders of a workpiece—so-called right and left shoulders—with the same chucking, particularly if the axis of rotation of the grinding tool is sloped with respect to the axis of rotation of the workpiece. The grinding tool can reach both shoulders, in that only the corresponding feeds are operated and without any rechucking of the workpiece. Another, very important advantage is that, by means of the new grinding tool, significantly higher grinding speeds can be achieved and thus significantly shorter processing times. In the case of the conventional grinding tools, the grinding speed, i.e., the circumferential speed of the abrasive coating, is limited mainly by the occurring centrifugal forces which, if certain rotational speed limits are exceeded, lead to a destruction of the abrasive coating. In the case of the new grinding tool, on the other hand, the abrasive coating is supported with respect to the centrifugal forces by means of the interior circumference of the ring so that the centrifugal forces affecting the abrasive coating practically no longer limit the grinding speed. Care must only be taken that the ring-shaped grinding tool itself and its holding elements withstand the centrifugal forces occurring at high rotational speeds.

In a further development of the invention, it is provided that the ring-shaped grinding tool is held in a ring-shaped holder which is pivoted and is connected with a rotating drive.

In order to permit, in a further development of the invention, a construction that is as compact as possible, it is provided that the ring-shaped holder is constructed as the rotor of an electric motor. As a result, a space-saving arrangement can be achieved.

In a further development of the invention, it is provided that the ring-shaped holder is supported by means of a gas bearing. This type of a gas bearing permits very high rotational speeds, without the occurrence of any significant wear.

The holder for the grinding tool, which rotates along with it, is subjected to the same high centrifugal forces so that it must be designed correspondingly for very high rotational speeds. In order to permit maximum rotational speeds, in the case of relatively large diameters of the ring-shaped grinding tool, it is provided in a further development that the ring-shaped holder is constructed as a composite body which has a basic body made of metal receiving the grinding tool and a reinforcement surrounding this basic body. The basic body, which consists of metal, has essentially the objective of ensuring dimensional stability, while the reinforcement surrounding it has the purpose of absorbing the forces which occur at extremely high rotational speeds of 10,000 $min^{-1}$ or more. In this case, it is provided in a particularly advantageous development of the invention that the reinforcement is formed by fibers extending in circumferential direction which are embedded in a matrix made of plastic. For this purpose, carbon fibers are suitable or filaments known by the trade name "Keflar" which are saturated with plastic and are wound around the basic body. In this case, it is provided that the fibers of these reinforcements are aligned unidirectionally in circumferential direction so that particularly high strengths are obtained in circumferential direction.

Other objects, advantages and novel features of the present invention will become apparent from the following detailed description of the invention when considered in conjunction with the accompanying drawings.

DETAILED DESCRIPTION OF THE DRAWINGS

Figure 1:
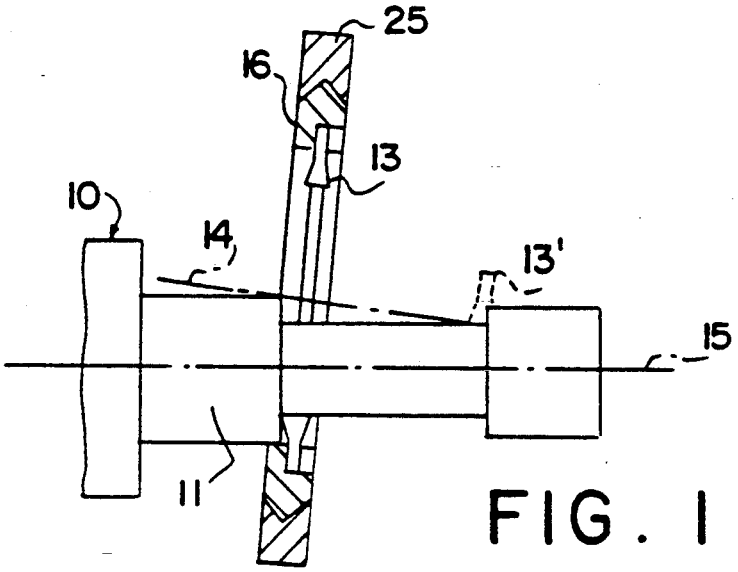
FIG. 1 is a schematic part sectional representation of a grinding device constructed according to the invention.

The device, which in FIG. 1 is shown only very schematically, has a chuck 10, into which a workpiece 11 is chucked, which is to be ground circular in its central area having a smaller diameter, this area, will then, toward both sides, be bordered by a shoulder which also has to be ground. The chuck 10, in a manner which is not described in detail, is equipped with a rotating drive and also with an advancing drive, as customary in grinding machines. During the grinding, the workpiece rotates around its axis 15.

The grinding work is carried out by means of a grinding tool 13, which has the shape of a ring, which is driven to perform rotations around an axis of rotation 14, specifically in the opposite direction of the rotation of the workpiece 11. The ring-shaped grinding tool has an abrasive coating at its interior circumference which will be explained below with reference to FIG. 3. The grinding tool 13 is chucked into a holder 16 which is also ring-shaped. This holder 16 is disposed in a stationary component 25 and is driven to perform rotations in a manner not shown in detail. As long as work takes place at relatively low rotational speeds, which however results in increased operating speeds, with respect to circular abrasive disks, a wharve may be mounted, for example, at the holder 16, by means of which wharve the holder 16 with the grinding tool 13 may be driven by a belt.

Figure 2:
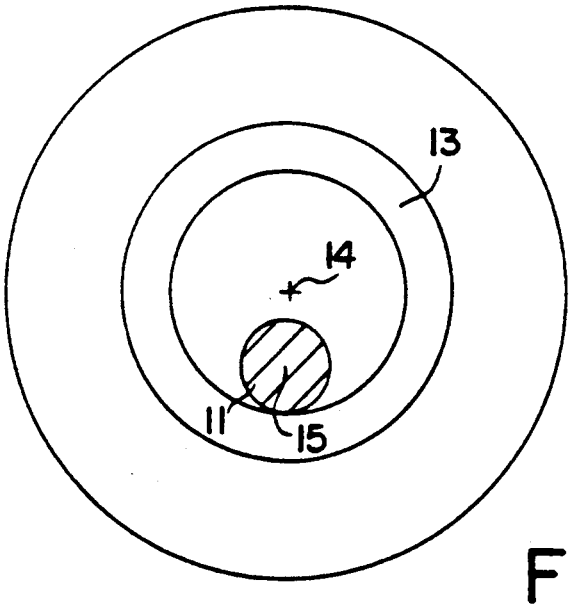
FIG. 2 is a radial sectional view of the device according to FIG. 1.

The axis of rotation 14 of the grinding tool 13 is located in a joint plane (FIG. 2) with the axis of rotation 15 of the chuck 10 and thus of the tool 11. As shown in FIG. 1, which is in a plane perpendicular with respect to the plane of FIG. 2, the two axes of rotation 14, 15 are arranged to be sloped with respect to one another within this joint plane. The angle of slope is between 5° and 10°. The stationary receiving device 25, in which the holder 16 is disposed, is held by means of a support which permits an adjustment transversely to the axis of rotation 14 and preferably also in longitudinal direction of the axis of rotation 14.

As shown in FIG. 1, the grinding tool 13, which widens in a slightly trapezoid shape in its cross-section with respect to its interior circumference, permits a circular grinding as well as a grinding of right and left shoulders, without the requirement of changing the chucking of the workpiece 11. As shown in FIG. 1 by means of position 13' of the grinding tool 13, it is sufficient to adjust the chuck 10 and the receiving device 25 relatively by means of one or both advances in order to reach this position 13'. As also shown in FIG. 1, the operating positions of the grinding tool 13, i.e., the operating position shown in FIG. 1 and position 13' with respect to the receiving device 25, are offset by 180° with respect to one another so that tolerances are absorbed.

As a modification of the shown embodiment, it is contemplated to arrange the receiving device 25 so that it can be swivelled and adjusted around an axis which extends perpendicularly with respect to the axis of rotation 14, so that the angle of slope between the axes of rotation 14, 15 of the tool 13 and of the workpiece 11 can be adjusted. Naturally, it is also contemplated to provide different types of chuckings and drives for a workpiece, in which case all possibilities may be considered which are known and possible in the case of grinding machines.

Figure 3:
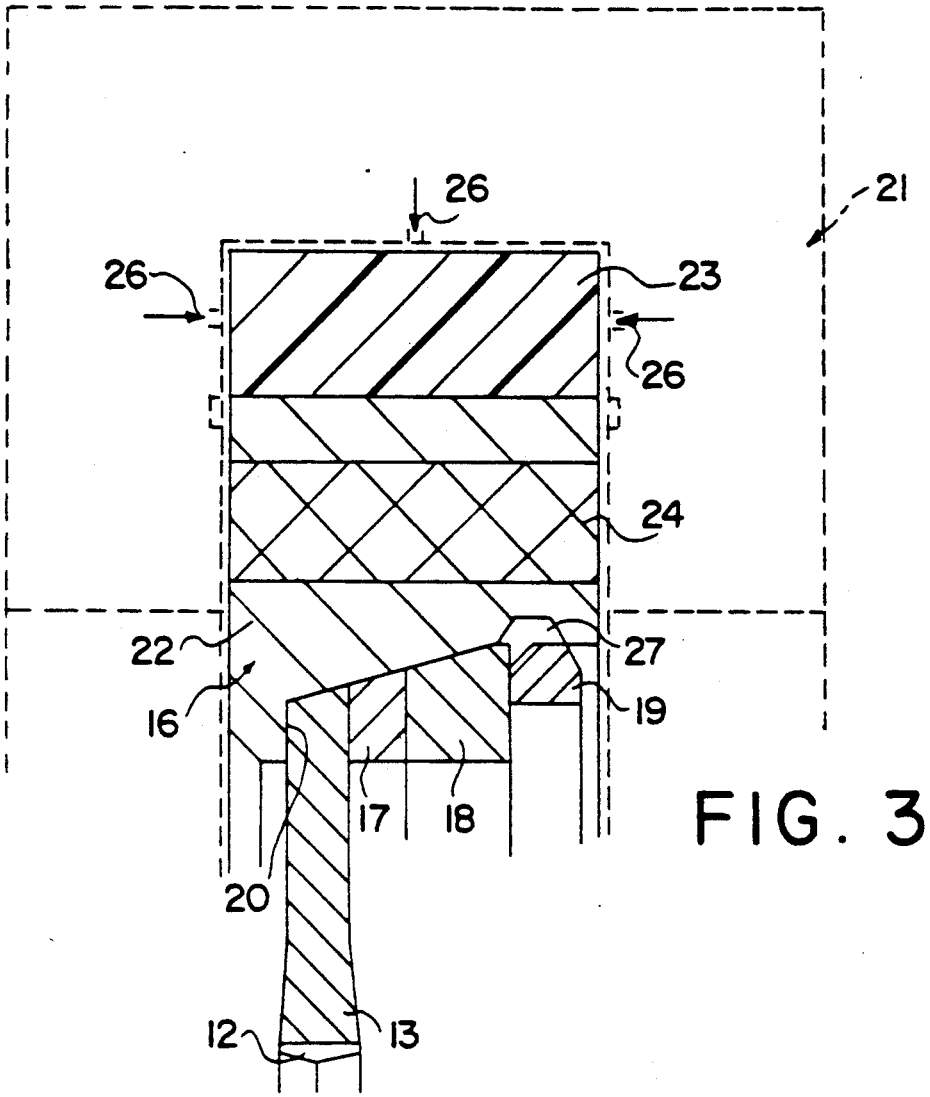
FIG. 3 is an axial sectional view of a ring-shaped grinding tool and a ring-shaped holder for the grinding tool constructed as the rotor of an electric motor.
Figure 4:
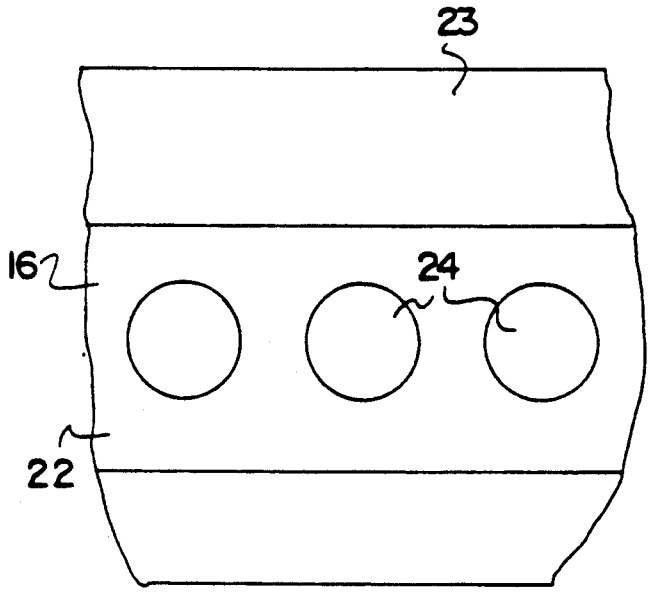
FIG. 4 is a view of the holder according to FIG. 3 in the axial direction.

In the case of higher rotational speeds, it is advantageous for the masses of the grinding tool and its holder 16, which must be driven, to be as small as possible despite the required dimensions. For this purpose, it is provided that the holder 16 is constructed as the rotor of an electric motor so that a direct drive is obtained. The receiving device 25 may then be constructed as the pertaining stator. If necessary, a separate stator may also be provided so that the bearing of the holder 16 is separate from the stator. FIGS. 3 and 4 show an embodiment in which the holder 16 of a ring-shaped grinding tool 13 is constructed as the rotor of an electric motor. The representation is slightly enlarged, in which case it should be taken into account that the diameter of the grinding tool 13, in the area of its abrasive coating 12, may be approximately 380 mm, and the outside diameter of the holder 16 may be approximately 600 mm. The workpiece diameter should not exceed approximately $\frac{3}{4}$ of the inside diameter of the ring-shaped grinding tool 13.

The holder 16 is provided with permanent magnets 24, to which corresponding windings are assigned of the stator 21 which is only outlined. Within the stator 21, the holder 16 is supported by means of a gas bearing, which, in FIG. 3, is shown only schematically. The holder 16 is provided with corresponding axial and radial bearing surfaces, to which openings 26 of the stator 21 are assigned, which are shown only schematically and through which a gas, particularly air, is fed at overpressure.

In order to provide a holder 16, which, despite the relatively large dimensions, still withstands the occurring centrifugal forces at the endeavored very high rotational speeds of 10,000 $min^{-1}$ or more, the holder 16 is constructed as a composite body. It consists of a basic body 22 made of a metal, particularly of aluminim or an aluminum alloy, i.e., of a material which has a relatively favorable ratio of stability to specific weight. In the case of the shown embodiment, the basic body 22 is provided with axial bores located on a ring-shaped area, the permanent magnets 24 being inserted in these bores. In order to achieve sufficient stability, the basic body 22 is also surrounded by a reinforcement 23. This reinforcement consists essentially of unidirectional fibers, particularly carbon fibers, which are wound around the basic body 22 and are embedded in a plastic matrix. For this purpose, the material which is sold by Ciba-Geigy, CH-Basel, under the name CFK T 300 may be used, for example, which is saturated in plastic, for example, in epoxy and which, in the form of threads, is wound onto the basic body 22 in several layers, where it hardens. The exterior surfaces of this reinforcement 23 are ground so that they form the bearing surfaces for the gas bearing. The part of fiber material in the reinforcement 22 amounts to approximately 80%, while the plastic matrix amounts to only approximately 20%.

As a modification of the shown embodiment, it is also contemplated to mount permanent magnets at the holder 16 in a different manner, for example, to arrange them on the outer circumference of the basic body 22 with the insertion of filling pieces and to hold them by means of the subsequently applied reinforcement 23. It is also contemplated to arrange these permanent magnets within the reinforcement 23, in which case, it may be provided under certain circumstances that a permanent-magnet material in powdery form can be supplied to the reinforcement 23 during the winding-on in a given manner.

The grinding tool 13 shown in FIG. 3 consists of a metal ring, for example, an aluminum ring, the cross-section of which widens, in a trapezoid shape, over approximate $\frac{1}{3}$ of its radial length toward the interior circumference. An abrasive coating 12 is attached at the interior circumference. As shown in FIG. 3, the grinding tool 13 may correspond approximately to the cross-section of a conventional abrasive disk, i.e., however in a reversed arrangement concerning the radial direction. The grinding tool 13 rests against a radial gripping surface 20 of the basic body 22, at which it is held by means of filling pieces 17, 18 and a clamping ring 19. The filling pieces 17, 18 also consist of a metal, preferably the same metal as the ring-shaped grinding tool 13, i.e., aluminum or an aluminum alloy. The clamping element 19 which, with an outer cone, is assigned to a conical groove 27 of the basic body 22, and expediently consists of a different material having a lower modulus of elasticity. It may, for example, consist of heavy plastic or brass or steel. Relatively hard rubber is also suitable, such as neoprene of a hardness of approximately 75 shore. The clamping element 19 is designed such that, as a result of the occurring centrifugal forces, it deforms elastically and, only at the nominal rotational speed, causes a bracing of the tool 13 with the gripping surface 20 via the filling pieces 17, 18.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Apparatus for grinding a workpiece comprising:
a rotating receiving device for a workpiece,
a grinding tool constructed as a ring which is provided with an abrasive coating on its interior circumference,
and means for driving the grinding tool to perform rotations with the abrasive coating grinding away a portion of an exterior surface around the workpiece held in the rotating receiving device to form a ground profile surface around the workpiece without cutting through the workpiece, wherein the axis of rotation of a said ring shaped grinding tool extends in a plane containing the axis of rotation of the workpiece and is inclined with respect to the axis of rotation of the workpiece in that plane.

2. Apparatus according to claim 1, wherein a axis of rotation of the ring shaped grinding tool extends parallel to the axis of rotation of the workpiece.

3. Apparatus according to claim 1, comprising adjusting means for adjusting relative angular positions of the axis of rotation of the grinding tool and the axis of rotation of the workpiece.

4. A device according to claim 3, wherein the ring-shaped grinding tool is held in a ring-shaped holder which is pivoted and is connected with a rotating drive.

5. Apparatus according to claim 1, wherein the ring-shaped grinding tool is held in a ring-shaped holder which is pivoted and is connected with a rotating drive.

6. Apparatus according to claim 5, wherein the ring-shaped holder is equipped with chucking devices for the chucking of the grinding tool, by means of which chucking devices the grinding tool can be braced with respect to a gripping surface which is essentially radial with respect to the axis of rotation.

7. Apparatus according to claim 5, wherein the ring-shaped holder is constructed as the rotor of an electric motor.

8. Apparatus according to claim 5, wherein the ring-shaped holder is supported by means of a gas bearing.

9. A device according to claim 5, wherein the ring-shaped holder is constructed as a composite body, which has a basic body made of metal, which accommodates the grinding tool, and the reinforcement, which surrounds this basic body.

10. A device according to claim 9, wherein permanent magnets are embedded in the reinforcement surrounding the basic body.

11. A device according to claim 9, wherein the reinforcement surrounding the basic body is provided with bearing surfaces for a gas bearing.

12. A device according to claim 5, wherein the ring-shaped holder is equipped with chucking devices for the chucking of the grinding tool, by means of which chucking devices the grinding tool can be braced with respect to a gripping surface which is essentially radial with respect to the axis of rotation.

13. Apparatus for grinding a workpiece comprising:
a receiving device for a workpiece,
a grinding tool constructed as a ring which is provided with an abrasive coating on its interior circumference,
a ring-shaped holder for holding the grinding tool,
and driving means for driving the ring-shaped holder and grinding tool to perform rotations with the abrasive coating grinding away a portion of an exterior surface of a workpiece held in the receiving device to form a ground profile surface on the workpiece without cutting through the workpiece,
wherein the ring-shaped holder includes a reinforcement surrounding the grinding tool, and
wherein the reinforcement is formed of fibers extending in circumferential direction, which fibers are embedded in a matrix made of plastic.

14. Apparatus for grinding a workpiece comprising:
a receiving device for a workpiece,
a grinding tool constructed as a ring which is provided with an abrasive coating on its interior circumference,
a ring-shaped holder for holding the grinding tool,
and driving means for driving the ring-shaped holder and grinding tool to perform rotations with the abrasive coating grinding away a portion of an exterior surface of a workpiece held in the receiving device to form a ground profile surface on the workpiece without cutting through the workpiece,
wherein the ring-shaped holder include a basic body made of metal, and
wherein permanent magnets are inserted into the basic body.

15. Apparatus for grinding a workpiece comprising:
a receiving device for a workpiece,
a grinding tool constructed as a ring which is provided with an abrasive coating on its interior circumference,
a ring-shaped holder for holding the grinding tool,
and driving means for driving the ring-shaped holder and grinding tool to perform rotations with the abrasive coating grinding away a portion of an exterior surface of a workpiece held in the receiving device to form a ground profile surface on the workpiece without cutting through the workpiece,
wherein the ring-shaped holder is constructed as the rotor of an electric motor.

16. A device according to claim 15, wherein the ring-shaped holder is supported by means of a gas bearing.

17. A device according to claim 16, wherein the ring-shaped holder is constructed as a composite body, which has a basic body made of metal, which accommodates the grinding tool, and a reinforcement, which surrounds this basic body.

18. A device according to claim 17, wherein the reinforcement is formed of fibers extending in circumferential direction, which are embedded in a matrix made of plastic.

19. A device according to claim 18, wherein permanent magnets are inserted into the basic body.

20. A device according to claim 18, wherein permanent magnets are embedded in the reinforcement surrounding the basic body.

21. A device according to claim 18, wherein the reinforcement surrounding the basic body is provided with bearing surfaces for a gas bearing.

* * * * *